US005649406A

United States Patent [19]

Sonntag et al.

[11] Patent Number: 5,649,406

[45] Date of Patent: Jul. 22, 1997

[54] POSITIONING APPARATUS FOR CONTAINERS DURING FILLING AND PACKAGING

[75] Inventors: Donald W. Sonntag, Titusville; James Bonner, Flemington, both of N.J.

[73] Assignee: Reagent Chemical & Research, Inc., Middlesex, N.J.

[21] Appl. No.: 327,467

[22] Filed: Oct. 21, 1994

[51] Int. Cl.[6] ..... B65B 7/14; B65B 57/04

[52] U.S. Cl. ..... 53/367; 53/75; 53/253; 53/544; 198/378

[58] Field of Search ..... 53/544, 367, 253, 53/76, 75, 77, 52; 198/378

[56] References Cited

U.S. PATENT DOCUMENTS

| | | | |
|---|---|---|---|
| 2,341,554 | 2/1944 | Johnson et al. | 198/378 X |
| 3,166,176 | 1/1965 | Turner | 198/378 |
| 3,611,662 | 10/1971 | Schmitt | 53/367 X |
| 4,285,186 | 8/1981 | Desom | 53/367 X |
| 4,669,376 | 6/1987 | Dominico et al. | 198/378 X |

FOREIGN PATENT DOCUMENTS

| | | | |
|---|---|---|---|
| 2849126 | 6/1979 | Germany | 198/378 |

*Primary Examiner*—James F. Coan

*Attorney, Agent, or Firm*—Timothy J. Martin; Michael R. Henson

[57] ABSTRACT

A positioning apparatus operates to advance and rotationally orient a container during packaging of a product and broadly comprises a conveyor, a rotor assembly mounted to the conveyor, a rotary drive means and orientation sensing means. The rotor assembly includes a holder adapted to receive a container in a supported state with the supported container being aligned along the rotor axis such that the container may be rotated thereabout. The rotary drive means operates to selectively engage the rotor assembly and the supported container for rotatably orienting the supported container with respect to the rotor axis. The orientation sensing means monitors rotational orientation of the supported container, and the conveyor operates to advance the rotor assembly and the supported container during the packaging of the product.

29 Claims, 6 Drawing Sheets

POSITIONING APPARATUS FOR CONTAINERS DURING FILLING AND PACKAGING

FIELD OF THE INVENTION

The present invention generally relates to apparatus operative to support a container during product packaging wherein the container is supported, filled with product and sealed. Particularly, the present invention is directed an improved rotatable support for such containers capable of properly orienting the containers in a rotational direction during automated packaging operations.

BACKGROUND OF THE INVENTION

As noted in my co-pending U.S. application Ser. No. 08/286,871, for FILLING APPARATUS WITH TRAVELLING NOZZLE, the increase in world's population has demanded the increased need to supply goods and services. In order to adequately distribute products, it is necessary that they be sufficiently packaged to protect the integrity of the product, to provide a uniform quality, to facilitate transport storage and display and to increase convenience to the user/purchaser.

Various industries employ a wide variety of packaging techniques for their various goods. Examples of such packaging techniques include boxes and cartons, paper and plastic bags, jars and bottles, metal cans, tubes, shrink wrapping and blister packs, to name a few. Where a manufacturer packages a product for distribution, it is often the case to place printed information on the package. Such information includes product identity, advertising copy, positioning statements, directions for use, etc., in an effort either to catch the eye of a possible purchaser, to explain the contents of the package or to inform the purchaser about the product and/or directions for using the product. Many containers employed by such manufacturers are pre-printed with such information prior to dispensing product into the package and sealing the package for further containerization (such as boxing multiple units of the product) and/or shipment.

Many of the containers employed in the industry are cylindrical in shape. By way of example, such containers include tubes, bottles (both glass and plastic) and cans. The rotational orientation of the containers during packaging and sealing of many such products is unimportant, however, a significant segment of the packaging industry requires that automated equipment be capable of rotationally orienting a container prior to sealing so that, when the sealed package is made, printed information on the package is properly positioned relative to the front or back of the package. Where the container, when completed, is rotationally symmetric, such as a cylindrical food or beverage can, rotational orientation is not usually critical. However, where the package may be the "toothpaste-tube" package that is not rotationally symmetric, proper rotational orientation is critical.

Heretofore, automated machinery has been known to allow rotational positioning of containers during a packaging operation so that the container is properly rotationally positioned. In such equipment, a conveyor is employed which conveyor has a plurality of container stations; each station then supports a container during the packaging operation. A popular type of such machine employs a dial conveyor wherein a circular conveyor rotates about a central axis and has a plurality of container receiving stations located along its circumferential margin. As the dial conveyor rotates, the container support stations are typically indexed from a container load assembly which places a container in the conveyor station, past a filling assembly wherein the container is filled with product, past a sealing station, wherein the container is sealed with the product packaged therein and finally to a discharge location wherein the filled and sealed container is ejected for further processing.

Where it is desired to rotationally orient the container prior to sealing, some mechanism must be provided to rotate the container relative to the conveyor. In the standard packaging assembly, this is accomplished by providing a container support that receives the container but which is not affixed to the conveyor. Before reaching the sealing station, and typically before being filled with product, a positioning mechanism lifts the container support off of the conveyor, rotates the container to properly orientate it and subsequently resets the supports onto the conveyor where it is held in position by its weight and the frictional contact with the conveyor.

While the above described positioning assembly works quite adequately when it properly functions, several circumstances can lead to problems. One such circumstance arises from the fact that translating forces or vibrations of the machinery can result in rotationally shifting the container support so that, even though it was once rotationally registered, it moves out of such proper registration. Another disadvantage can arise if the container support is not repositioned properly so that the container is not axially aligned for the subsequent packaging procedures. For example, if the container is even slightly canted relative to its intended position, the container may be broken or damaged. Expensive damage can also occur to the filling and sealing equipment, or the filling and sealing operations will not be properly performed.

Another disadvantage of packaging equipment using such rotational positioning apparatus, is the need to adjust the dispensing equipment and the sealing equipment to properly position them relative to the container when different container sizes are filled. For example, where it is desired to fill a tubular container that is twice as long as a previously used container, it is necessary to adjust the height of both the dispensing equipment and the sealing equipment to accommodate the increased length of the second, longer tubular container. Such adjustments are extremely time consuming and are thus expensive from a manpower consideration as well as idle time for the equipment.

Accordingly, there has been a long-felt need for improvements to such automated equipment to eliminate these disadvantages. There is a need for such improvements in such machinery for supporting containers and for rotatably positioning such containers more efficiently while eliminating the likelihood of misregistration of the containers as well as misalignment during filling and sealing procedures. The present invention is directed to meeting such needs.

SUMMARY OF THE INVENTION

It is an object of the present invention to provide a new and useful positioning apparatus for supporting, advancing and rotationally orienting a container during the packaging of a product.

Another object of the present invention is to provide a positioning apparatus which can receive and rotationally position a container during packaging without disengaging the container support from a product station.

A further object of the present invention is to provide a container support and positioning apparatus which can accommodate containers of different lengths and diameters without the need for elaborate adjustment of the dispensing and sealing equipment used in automated packaging equipment.

Still a further object of the present invention is to provide positioning apparatus that is operative to support, advance and rotationally orient containers during the packaging of products wherein such positioning apparatus reduces the likelihood of misregistration and misalignment of respective containers with the dispensing and sealing equipment of such automated machinery.

According to the present invention, then, positioning apparatus is provided that is operative to support, advance and rotationally orient a container during the packaging of a product. Broadly, this positioning apparatus includes a conveyor and a rotor assembly mounted on the conveyor for rotational movement about a rotor axis. The rotor assembly includes a holder adapted to receive a container in a supported state so that the supported container is aligned along the rotor axis and such that the supported container may be rotated about the rotor axis. A rotary drive is operative to selectively engage the rotor assembly and the supported container for rotatably orientating the supported container with respect to the rotor axis. A sensor is provided for monitoring the rotational orientation of the supported container. During the packaging of a product, the conveyor is operative to advance the rotor assembly and supported container. If desired, the rotor assemblies can be organized as rotor pairs at selected spacing along the conveyor.

While the broad form of the present invention may be used with different types of conveyors, it is contemplated that the present invention is particularly useful with rotary dial conveyors wherein a multiple of product stations are located in spaced-apart relation to one another around a circumferential margin of the rotary dial. In any event, where multiple stations are present, the present invention employs a rotor assembly at each such station.

Preferably, the holder for the container in the present invention includes a rotor mounted on the conveyor for rotational movement about a rotor axis with which the container is aligned. A plurality of rails mounted on the rotor and extend in an upright manner therefrom. A first collar is supported on the rails in spaced relation to the rotor and is operative to receive the container. Thus, the rails and the first collar are mounted for common rotational movement about the rotor axis. The first collar preferably includes a gripping element operative to releaseably grip the supported container, and this gripping element may conveniently be a resilient O-ring. Preferably, the first collar is annular in configuration and has an inner sidewall that is provided with an annular channel, the O-ring that provides the gripping element is received in the channel. Alternatively, opening may be made in the annular sidewall, and the O-ring is mounted around the first annular collar such that portions of the O-ring protrude into through the openings to engage the supported container. It is preferred that the first collar be slidably disposed on the rails and may be releasably locked into position so as to position containers of different lengths so as to orient the open (i.e., "fill") end of containers of different lengths in coplanar relation to an imaginary plane located a selected space distance from the conveyor.

A second annular collar is preferably provided and is disposed on the rails at an upper end thereof so that the first collar is positioned between the rotor and the second collar. The first and second collars thereby define a holder set that is dimensioned for cylindrical containers of a selected diameter. The present invention then includes the use of a plurality of holder sets which may be selectively and interchangeably mounted on the rotor rails so as to accommodate containers of different diameters.

In order to releasably retain the rotor of each holder at a selected rotational orientation about the rotor axis, a brake assembly is provided and is associated with each rotor assembly. The brake assembly includes a brake actuable between a braking state to prohibit rotational movement of the holder and a release state to allow rotational movement of the holder. A brake actuator is provided to selectively place the brake in the braking and release states. Wherein the rotor assembly includes a rotor disposed on the conveyor, the brake may be formed by an arm member moveable into and out of frictional contact with the rotor. This arm member is preferably resiliently biased into the braking state. One such arm member is described is mounted to the conveyor proximate to the rotor for reciprocal movement tangentially thereto. Here, the arm member includes a shaft and an enlarged head. The enlarged head contacts the rotor when in the braking state, but the enlarged head is moved out of contact with the rotor when in the release state. Where the rotor assemblies are organized as rotor pairs, a single member many be interposed between each rotor assembly of the rotor pair to act as a common brake therefor. Alternatively, the arm member may be a lever pivotally mounted to the conveyor proximate to the rotor for pivotal movement into contact with the rotor when in the braking state and out of contact with the rotor when in the release state. The brake actuator may be an air actuated cylinder, solenoid or other structure operative upon actuation to move the arm member into the released state.

These and other objects of the present invention will become more readily appreciated and understood from a consideration of the following detailed description of the preferred embodiment when taken together with the accompanying drawings, in which:

DETAILED DESCRIPTION OF THE EXEMPLARY EMBODIMENTS

The present invention is directed to positioning apparatus which is operative to support, advance and rotationally orient a container during the packaging of a product. In its broad form, the present invention includes a conveyor which acts to transport at least one container, but preferably a plurality of containers. To do this, the conveyor has one or more rotor assemblies which are mounted on the conveyor for rotational movement, each about a rotor axis. Each rotor assembly includes a holder adapted to receive a container in a supported state so that the supported container is aligned along a rotor axis so that the container may be rotated about that axis. A rotary drive then operates to selectively engage each rotor assembly and the supported container for rotatably orienting the supported container with respect to the rotor axis. In order to sense proper registration, orientation sensing means for monitoring rotational orientation is provided.

Figure 1:
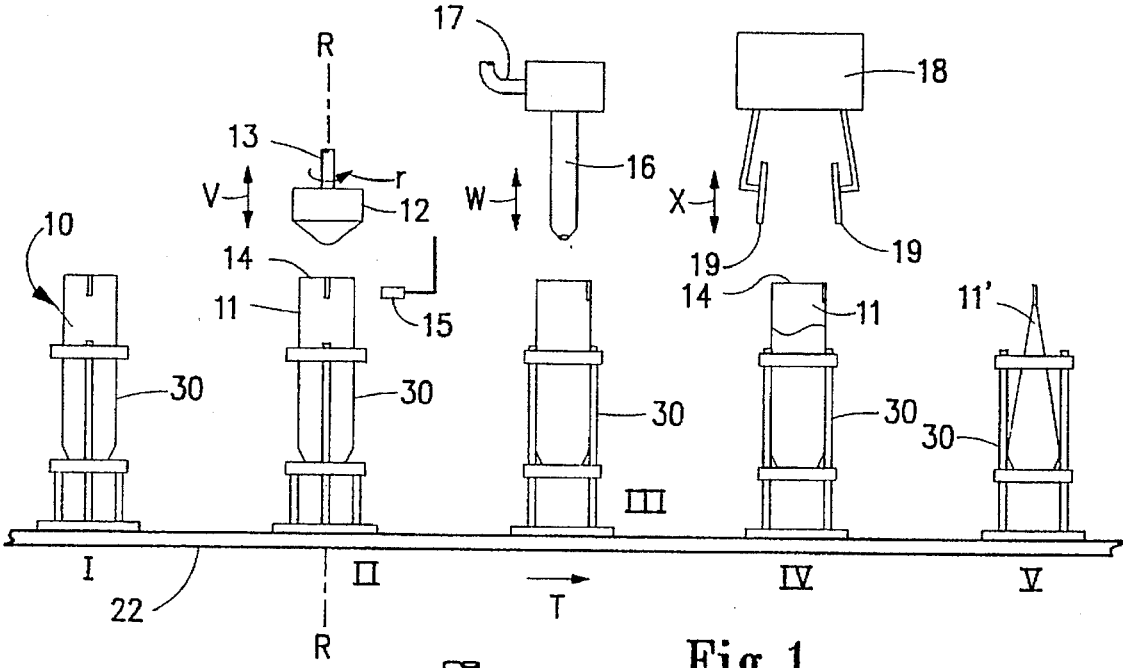
FIG. 1 is a diagrammatic view of an exemplary embodiment of automated packaging equipment with which the exemplary embodiment of the present invention may be employed.

As such, the present invention is adapted to be used in conjunction with existing packaging equipment. A diagram of such equipment used in conjunction with the present invention is thus shown in FIG. 1. In FIG. 1, a positioning apparatus 10 is shown to comprise a plurality of rotor assemblies 30 each mounted on a conveyor 20 for translation in the direction of arrow "T". While conveyor 20 diagrammed in FIG. 1 appears to be a linear conveyor, in the exemplary embodiment described below, conveyor 20 is in the form of a rotary dial of a type known in the art. However, it should be understood that the present invention is not limited solely to rotary dial conveyors.

In any event, each rotor assembly 30 is progressively advanced in the direction of arrow "T" first past a rotary drive that is operative to position a container 11 in proper rotational position about a rotor axis such as axis "R". At Stage I, a container 10 is shown in a supported, but unregistered state. It is then advanced to Stage II where it is ready for rotational orientation. For example, a rotor drive at Stage II may be in the form of a drive wheel 12 supported on a shaft 13 such that drive wheel 12 may be rotated, for example, in the direction of "r". Drive wheel 12 may also be reciprocally translated in the direction of "V" so that it may move into engagement with an open or "fill" end 14 of container 11, as shown in FIG. 1. Drive wheel 12, when engaged with container 11, positionally orients the container at a proper angular orientation with respect to axis "R". This position may be detected by an orientation sensing means, such as a photocell 15, shown in FIG. 1 and described more thoroughly below.

The supported container 11 next moves to Stage III where it is filled with a product such as a material to be dispensed from a dispensing nozzle assembly 16 connected to a source of product to be packaged through hose 17, by way of example. Nozzle assembly 16, if desired, can translate in the direction of arrow "W" so as to provide a bottom-to-top fill for container 11. One such example of a dispensing apparatus capable of performing such function is described in my co-pending patent application, Ser. No. 08/286,871.

After being filled, by whatever dispensing nozzle is used, the supported and filled container moves to Stage IV wherein it is sealed by a traditional heat sealer 18 which may translate in the direction of arrow "X" and which includes heated plates 19 which reciprocate to collapse and heat seal open end 14 of container 11. The result, as shown at Stage V, is a sealed container 11' which, in the diagrammed example of FIG. 1, is in the form of a toothpaste type of product. At this Stage V, sealed container 11' is ready for discharge for further packaging or other processing.

It should be understood specifically with reference to FIG. 1 that the structure of the rotational drive, such as drive wheel 12, the structure of dispensing nozzle 16 and the structure of sealer 18 is not critical to the scope of the present invention. It is believed that the present invention may be employed with a variety of other different equivalent structures as known to the ordinarily skilled person in this field. For example, the rotational drive could directly act on rotor assembly 30 rather than engaging directly the supported container 11. Nozzle 16 need not translate may simply dispense product at Stage III. Likewise, it is not necessary to translate heat sealer 18 if the heating plates are properly positioned so that the end of the container pass therebetween. Indeed, such a sealer can be replaced with other container closure systems such as lid seamers and the like, depending upon the particular application and type of container to be sealed. Moreover, it would be possible to reverse Stages II and III whereby the rotational positioning would take place after the filling operation although it is preferred that the rotational positioning take place while the container is empty. It should specifically be understood that the present exemplary embodiment is described with respect to sealing squeeze tube of the type commonly referred to as "toothpaste" tubes but that this description is for illustrative purposes only and is in no way to be construed as a limitation on the type of container with which the present invention may operate.

Figure 2:
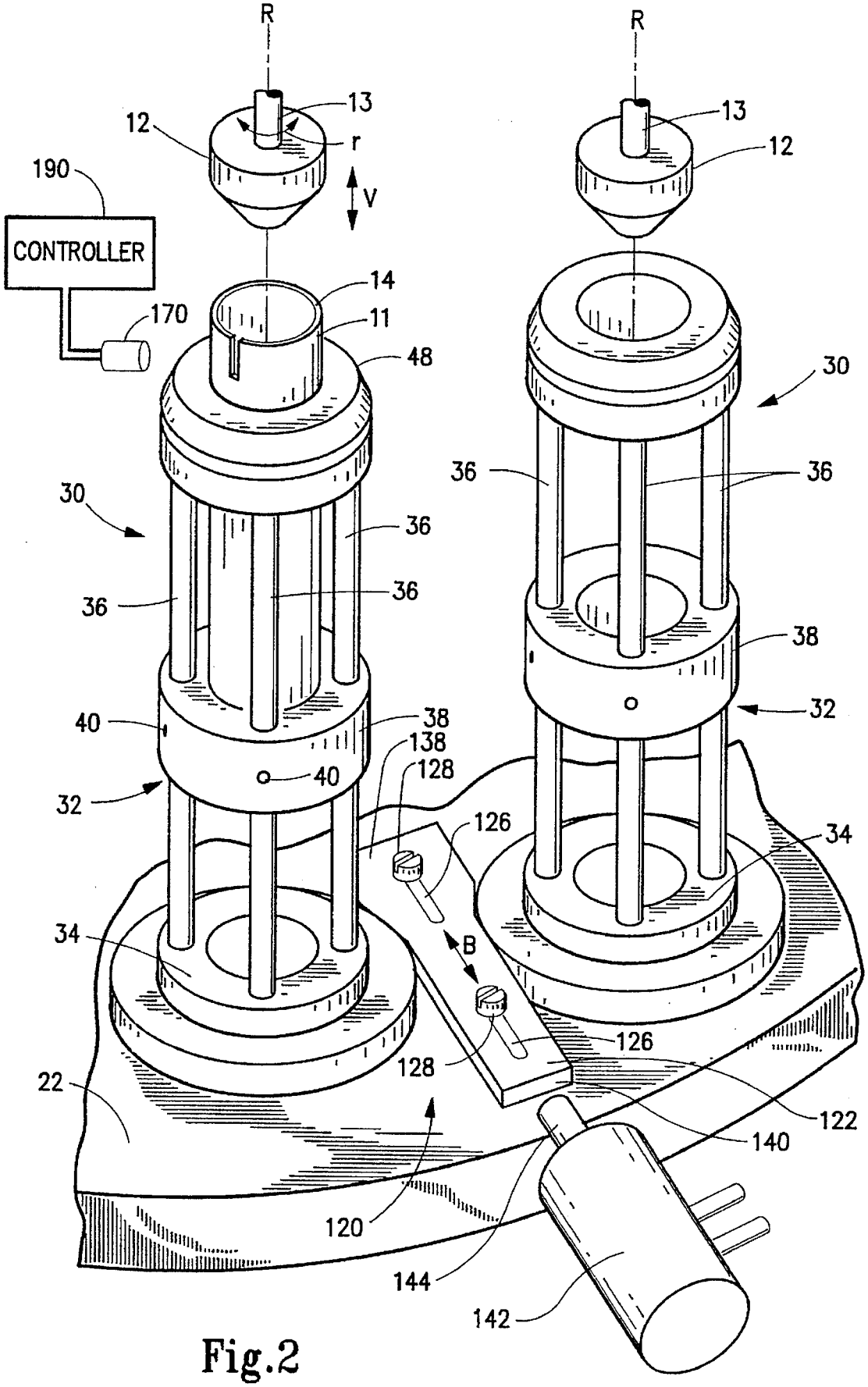
FIG. 2 is a perspective view of a pair of container holding stations according to the first exemplary embodiment of the present invention.

With these considerations in mind, an understanding of the structure of a rotor assembly according to the first exemplary embodiment of the present invention may best be seen with reference to FIGS. 2–7. In FIG. 2, it may be seen that each rotor assembly 30 includes a holder 32 adapted to receive a container, such as container 11, in a supported state as a supported container. Rotor assemblies 30 are affixed to conveyor 22 and are rotatable thereon, although any technique for securing the rotor assemblies 30 to conveyor 22 without requiring their disengagement from conveyor 22 to position the supported container is within the scope of this invention. The supported container 11 is thus aligned along the rotor axis "R" which is preferably perpendicular to the plane of the conveyor 20 which, as illustrated in FIG. 2, is a rotary dial conveyor 22. Holder 32 includes a rotor 34 which supports a plurality of upright rails 36 generally in a parallel relationship with rotor axis "R". A first collar 38 is supported on rails 36 in spaced relation to rotor 34 and may be slidably positioned therealong. Collar 38 may be locked into position by means of any suitable locking mechanism, for example set screws 40. Collar 38 supports a lower end of container 11 opposite open end 14. Accordingly, rails 36 and collar 38 are mounted on rotor 34 for common rotational movement about axis "R". A second collar 48 is preferably mounted on rails 36 opposite rotor 34 and is stationary with respect to rails 36. Thus, second collar 38 also commonly rotates with rotor 34, first collar 38 and rails 36, about rotationally axis "R". In FIG. 2, a pair of rotor assemblies 30 are shown as a rotor pair.

Figure 3:
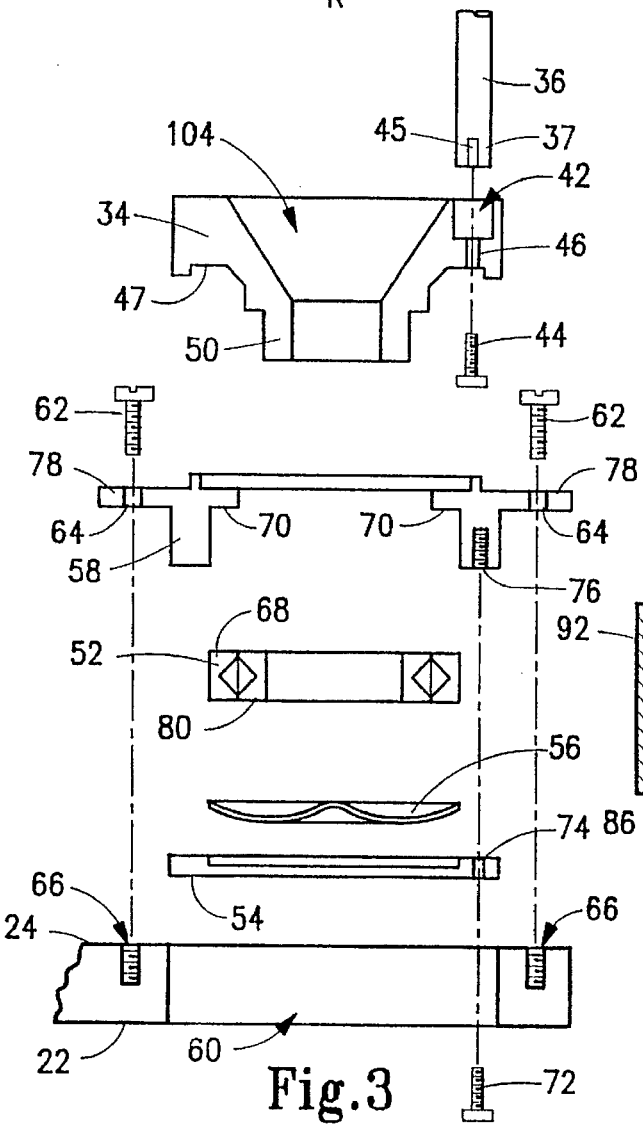
FIG. 3 is an exploded side view in partial cross-section showing the rotor structure of FIGS. 2–4.
Figure 5:
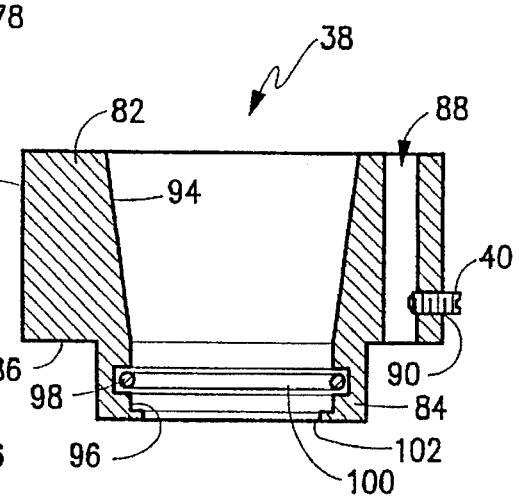
FIG. 5 is a side view in cross-section showing an enlarged view of a first collar according to the first exemplary embodiment of the present invention.
Figure 4:
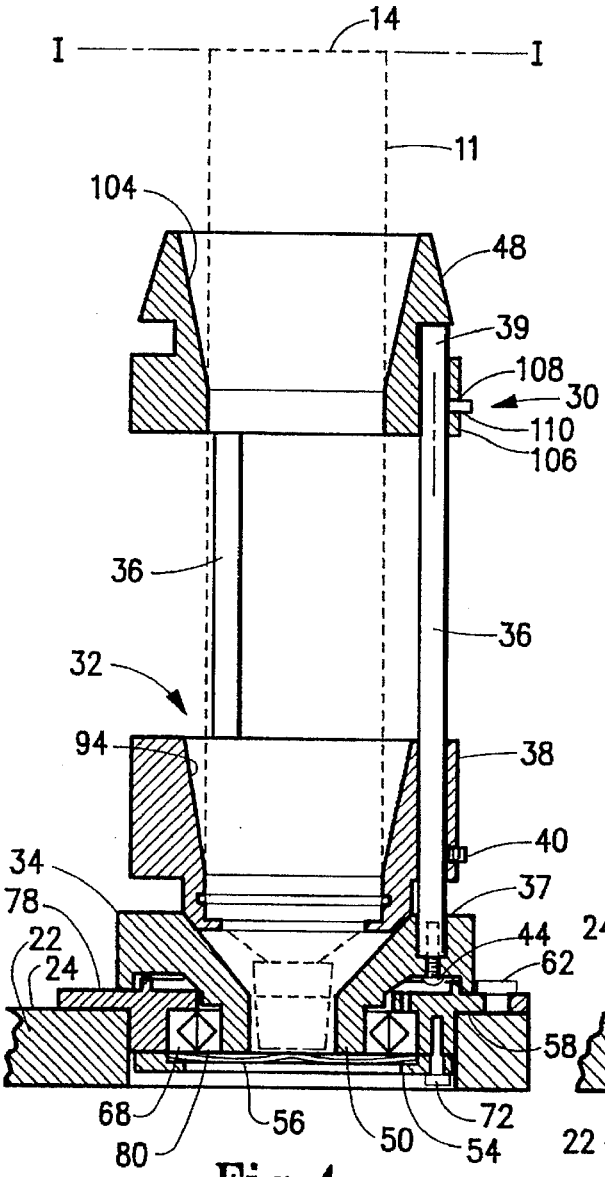
FIG. 4 is a side view in cross-section of a container holding station according to the first exemplary embodiment of the present invention shown receiving first container of a selected length.

The structure of an exemplary rotor assembly 30 is shown in greater detail in FIGS. 3–5. In FIG. 3, it may be seen that rotor 34 has a plurality of bores, such as bores 42, operative to receive a lower end 37 of rails 36. Rails 36 are secured within bores 42 by means of a screw 44 threadably received in hole 45 formed in the lower end of rails 36. To this end, a bore 46 extends through a lower surface 47 of rotor 34 and communicates with bore 42. Rotor 34 is generally in the form of an inverted frustum and has a vertex portion 50 sized to be press-fit into a bearing 52 which is mounted by means of a retainer plate 54 and a leaf spring 56 to a base member 58. Base member 58 is matably received in circular opening 60 in rotary dial 22 and is retained in position by means of screws 62 passing through holes 64 and threadably received in bores 66 formed in rotary dial 22. Bearing 52 is press-fit into annular base member 58 so that an outer section 68 of bearing 52 rests against shoulder 70 of annular base member 58. Bearing 52 can be of a variety of constructions, such as a low-friction bushing as well as the traditional roller bearing. Leaf spring 56 and retainer plate 54 then cover bearing 52 with retainer plate 54 being held in position by screws 72 passing through holes 74 and into threaded bores 76 in annular base member 58.

When mounted on rotary dial 22, annular base member 58 has an outwardly projecting flange 78 which rests on upper surface 24 of rotary dial 22. Bearing 52 has an inner section 80 into which vertex portion 50 of rotor 34 is pressed, and it should now be understood that inner section 80 of bearing 52 freely rotates with respect to outer section 68 thereof. Thus, base member 58, retainer plate 54, leaf spring 56 and outer section 68 (of bearing 52) are relatively stationary with respect to rotary dial 22. On the other hand, inner section 80 of bearing 52, rotor 34 and rails 36 may freely rotate about rotational axis "R" with respect to rotary dial 22.

Collar 38 is best shown in FIG. 5 where it may be seen that collar 38 has a disk-shaped central section 82 that has a neck portion 84 extending axially therefrom to define a shoulder 86. Longitudinally extending passageways 88 extend through the outer circumferential margin of central section 82, along shoulders 86, with passageways 88 being sized and adapted to slidably receive rails 36 so that collar 38 may be adjustably positioned therealong. A threaded bore 90 extends through cylindrical side 92 of collar 38 to intersect passageway 88. Threaded bore 90 is threaded to receive set screw 40 so as to selectively lock collar 38 into a desired location along rails 36. Collar 38 has an inner flared sidewall 94 sized and adapted to receive a container 11 of selected diameter. Sidewall 94 is upwardly divergent so as to facilitate entry of a container 11 into collar 38. Neck portion 84 has an inner cylindrical sidewall 96 provided with an inwardly opening circumferential groove 98 that receives an O-ring 100 that provides a gripping element to retain a supported container 11. Neck portion 84 also has an inwardly turned lip 102. With this construction, the closed end of a tubular container 11 may be received in collar 38 so as to be supported by lip 102. O-ring 100 flexes to resiliently engage and grip container 11, as is shown in FIG. 4, to help retain container 11 as a supported container. To this end also, it should be appreciated with reference to FIGS. 3 and 4 that rotor 34 has a frustoconical opening 104 sized and adapted to receive a nozzle portion of container 11, again as is shown in FIG. 4.

Figure 6:
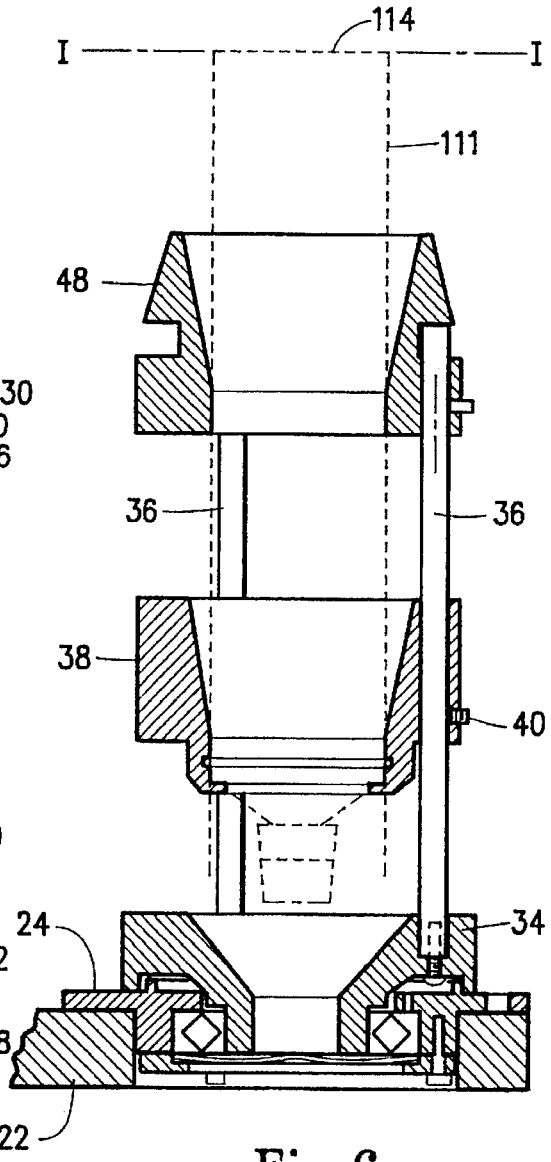
FIG. 6 is a cross-sectional view of the container holder of FIG. 4 but showing it in a second position for receiving and supporting a second container of lesser length than the first container shown in FIG. 4.
Figure 7:
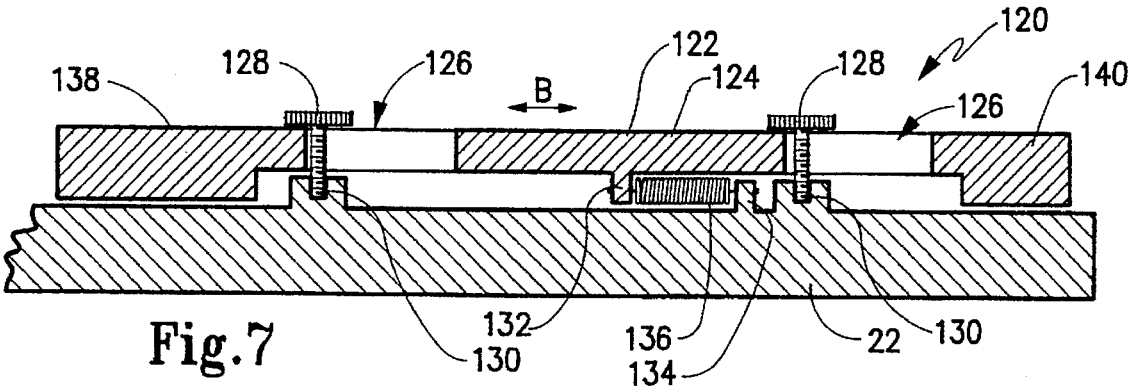
FIG. 7 is a side view in cross-section showing the brake arm according to the first exemplary embodiment of the present invention.

Second collar 48 may be seen best in FIGS. 4 and 6. Here, collar 48 is annular in configuration and has an inner flared sidewall 104 which upwardly opens so as to facilitate mounting of container 11, but sidewall 104 is sized for close-fitted engagement with container 11. A longitudinal passageway 106 extends into collar 48 so as to matably receive an upper end 39 of rails 36, and collar 48 is locked onto rails 36 by means of a set screw 108 extending through threaded bore 110 that intersects passageway 106.

With reference to FIGS. 4 and 6, it may be appreciated that containers of different length may be supported by holder 32 simply by adjusting the position of first collar 38. In FIG. 4, it may be seen that container 11 has an open end 14 that is positioned in an imaginary plane "I" located a selected spaced distance above upper surface 24 of rotary dial 22. In FIG. 6, a shorter container 111 is depicted in phantom. Here, container 111 is shorter in length than container 11 but is of a common diameter. Due to the repositioning of collar 38, however, open end 114 can also be oriented in the imaginary plane "I" so that the effective height of container 111 above surface 24 is identical to that of container 11. Accordingly, the position of the sealer such as sealer 18 and its plate 19 need not be altered for containers of different lengths. This advantage would obtain for other production stages as well.

According to the exemplary embodiment of the present invention, it is also desirable to provide a mechanical brake assembly which acts to prevent rotation of the rotor assembly and supported container at times other than intended. Thus, a brake assembly is provided such as brake assembly 120 shown in FIG. 2. Brake assembly 120 is best shown in reference to FIG. 2 and FIG. 7 wherein it may be seen that the brake assembly includes a brake that includes an arm member 122 that is mounted on rotary dial 22 and is movable tangentially to rotors 34 of each of rotor assemblies 30 in the direction of arrow "B". More specifically, with reference to FIG. 7, it may be seen that arm member 122 has a central section 124 provided with a pair of spaced-apart, longitudinally slots 126 through which mounting screws 128 extend to engage upright posts 130 formed on rotary dial 22. Central section 124 has a downwardly depending prong 132 and rotary dial 22 has an upwardly extending prong 134, and a biasing spring 136 is mounted therebetween. An enlarged head 138 is provided at an inner end of arm member 122, and, with reference to FIG. 2, it may be seen that spring 136 acts to resiliently engage enlarged head 138 with rotors 34 for frictional braking contact therewith. Central section 124 thereby provides a shaft so that arm member 122 may undergo reciprocal movement tangentially to rotors 34 such that the enlarged head 138 contacts the rotor when in the braking state and wherein the enlarged head is moved out of contact with the rotor when in the released state. To this end, an actuator is provided in order to act on end 140 of central section 124 opposite enlarged head 138. In FIG. 2, this actuator may be an air activated cylinder 142 which activates plunger 144 so that, upon activation, plunger 144 moves outwardly of cylinder 142 to contact end 140 thereby to move arm member 122 into a release state wherein head 138 is moved out of frictional contact with rotors 34. Other actuators could readily be used,however, as would be appreciated by the ordinarily skilled artisan.

Figure 8B:
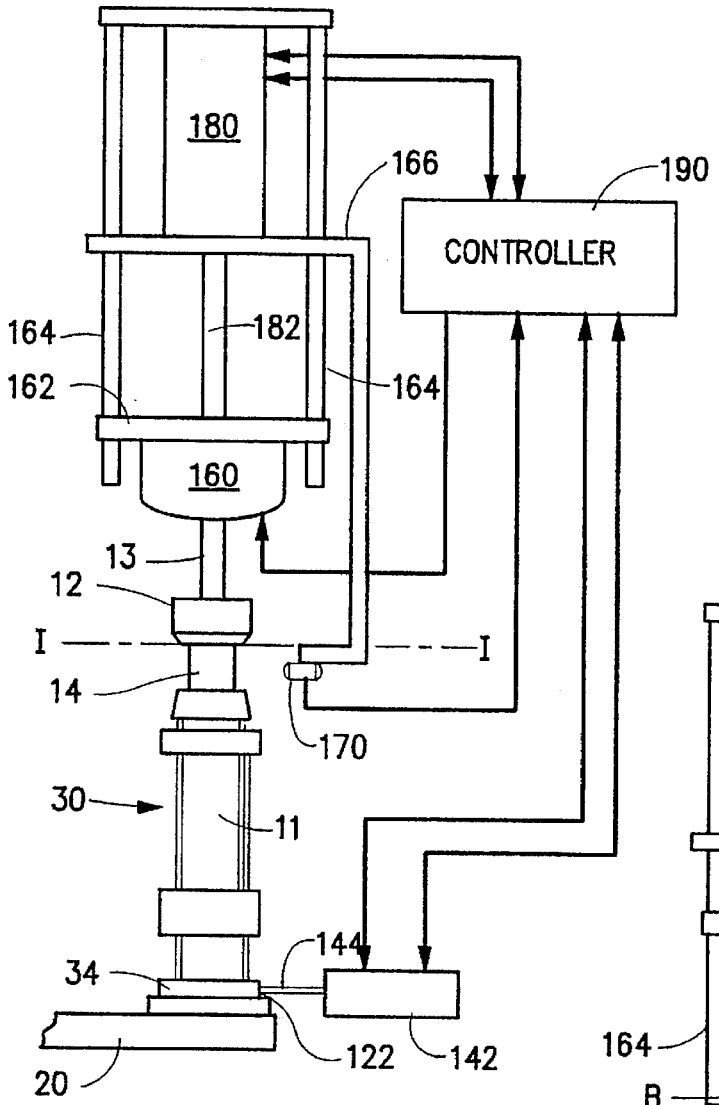
FIGS. 8(*a*) and 8(*b*) are diagrammatic view showing a container received in the container holder of FIGS. 2–7 prior to being rotationally positioned (FIG. 8(*a*)) and showing the container after being rotationally positioned (FIG. 8(*b*))
Figure 8A:
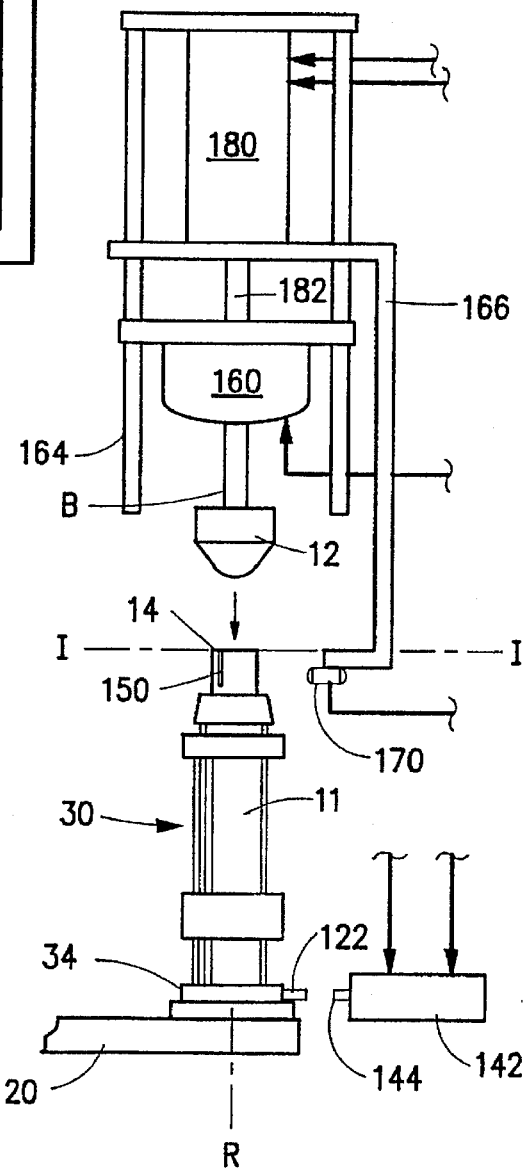

The operation of the rotational positioning of the rotor assembly 30 and supported container 11 therein may now be more fully appreciated with references to FIGS. 8(*a*) and 8(*b*) and FIG. 2. In FIG. 8(*a*), it may be seen that rotor assembly 30 is advanced into position which corresponds to Stage II (FIG. 1) wherein container 11 is to be rotationally positioned about axis "R". Open end 14 is seen to be positioned in the imaginary plane "I" and is provided with an index marking 150 adjacent thereto. In the position shown in FIG. 8(*a*) arm member 122 is in the brake state thereby resisting rotational movement of rotor assembly 30. This would also be the position shown in FIG. 2. However, upon activation of air cylinder 142, plunger 144 engages arm member 122 to move it into a release state wherein head 138 disengages rotors 34. At this point, wheel 12 and its motor drive 160 is advanced to engage open end 14 as shown in FIG. 8(*b*). Wheel 12 rotates thereby rotating rotor assembly 30 in container 11 until registration mark 150 is sensed by photocell 170. When container 11 is properly positioned, as determined by photocell 170 and controller 190, air cylinder 142 is then again activated to withdraw plunger 144 into the position shown in FIGS. 2 and 8(*a*) thereby again braking rotors 34 against rotation. Rotor assembly 30 and the aligned or registered container 11 may be advanced to the fill station of Stage III.

It should be understood at this juncture that a variety of different positioning apparatus could be used to rotate rotor 30 and container 11 and different sensing systems could be used. For example, a motor drive, either gear-based or wheel-based could move into engagement with rotor 34, collar 38 or collar 48. A drive wheel, such as drive wheel 12, could also move into position with rotor 34 from the underside of rotor dial 22 opposite surface 24 for this rotational positioning. In FIGS. 8(*a*) and 8(*b*) however, a positioning assembly is diagrammed for reference purposes only. Here, motor 160 carries shaft 13 with motor 160 being mounted on a carriage 162 which, in turn, is slidably received on rails 164 supported by frame 166. An air activated cylinder 180 is also supported by frame 166 and includes a plunger 182 such that, upon activation in a first direction, plunger 182 moves carriage 162 so that wheel 12 engages open end 14 of container 11, as is shown in FIG. 8(*b*). Upon activation of air cylinder 180 in a second direction, plunger 182 moves carriage 162 upwardly so that wheel 12 disengages the container 11, as is shown in FIG. 8(*a*). In any event, it is desirable that the activation of air cylinders 142 and 180 be controlled by a controller 190 that also receives the signal from sensor 170. Controller 190, if desired, may also control the dispensing and sealing Stages (Stages III and IV) shown in FIG. 1. Moreover, controller 190 can also act to control the initial positioning of an unfilled container at Stage I and the removal of the filled and sealed container 11' at Stage V. Such controllers are already known in the art and are commonly used on such equipment.

Figure 9:
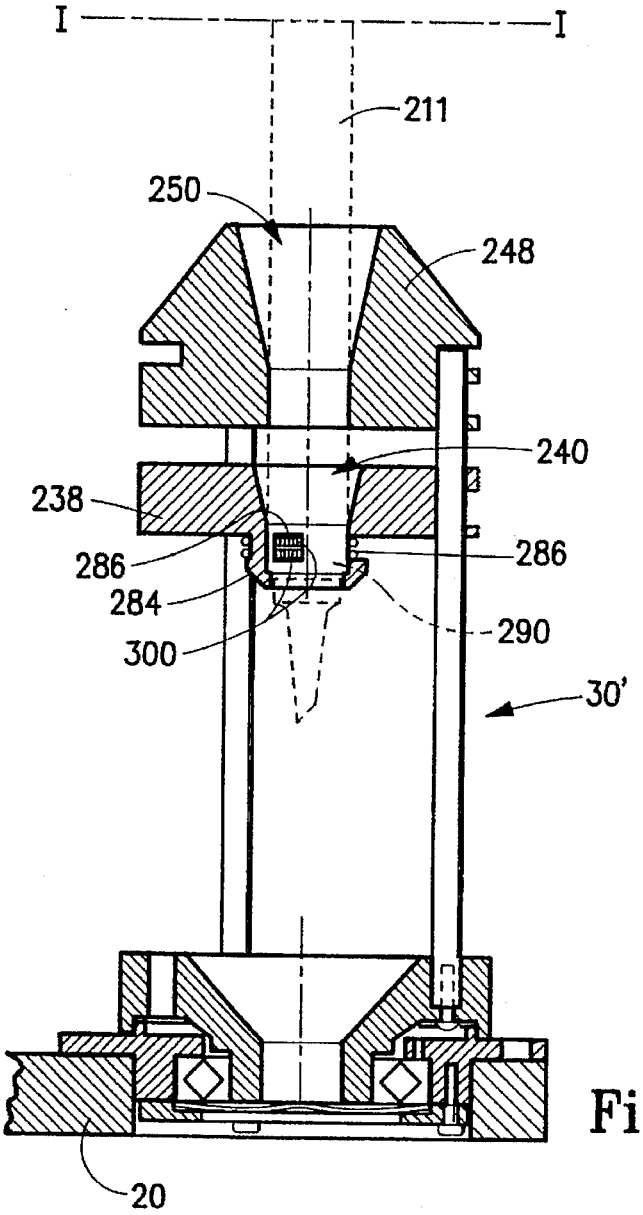
FIG. 9 is a side view in cross-section, similar to FIGS. 4 and 6, but showing a second holder set for holding a container of smaller diameter than that shown in FIGS. 4 and 6 and showing an alternative frictionally retainer for such container.

It should also be understood that containers of different diameters may be supported, advanced and rotationally oriented by the positioning apparatus of the present invention. This is accomplished by having the first and second collars defining a holder set and by including a plurality of interchangeable holder sets adapted to support containers of differing sizes. Thus, for example, as is shown in FIG. 9, rotor assembly 30' is adapted to mount a container 211 that is smaller in diameter,than container 11 discussed in FIG. 2–8. Here, a second holder set as defined by first collar 238 and second collar 248 which have their respective openings 240 and 250 with smaller diameters sized and adapted to snugly receive container 211. In FIG. 9, it may also be appreciated that an alternative gripping element structure is provided to resiliently grip tube 211 in rotor assembly 30'. Here, neck portion 284 of first collar 238 is provided with a plurality of windows, such as windows 286, and a pair of O-rings 300 extend circumferentially around neck portion 284 so that a portion of O-rings 300 are exposed within windows 286. Due to the resiliency of O-rings 300, the end portion 290 of container 211 is resiliently gripped by O-rings 300 located within the window portions 286.

Figure 10:
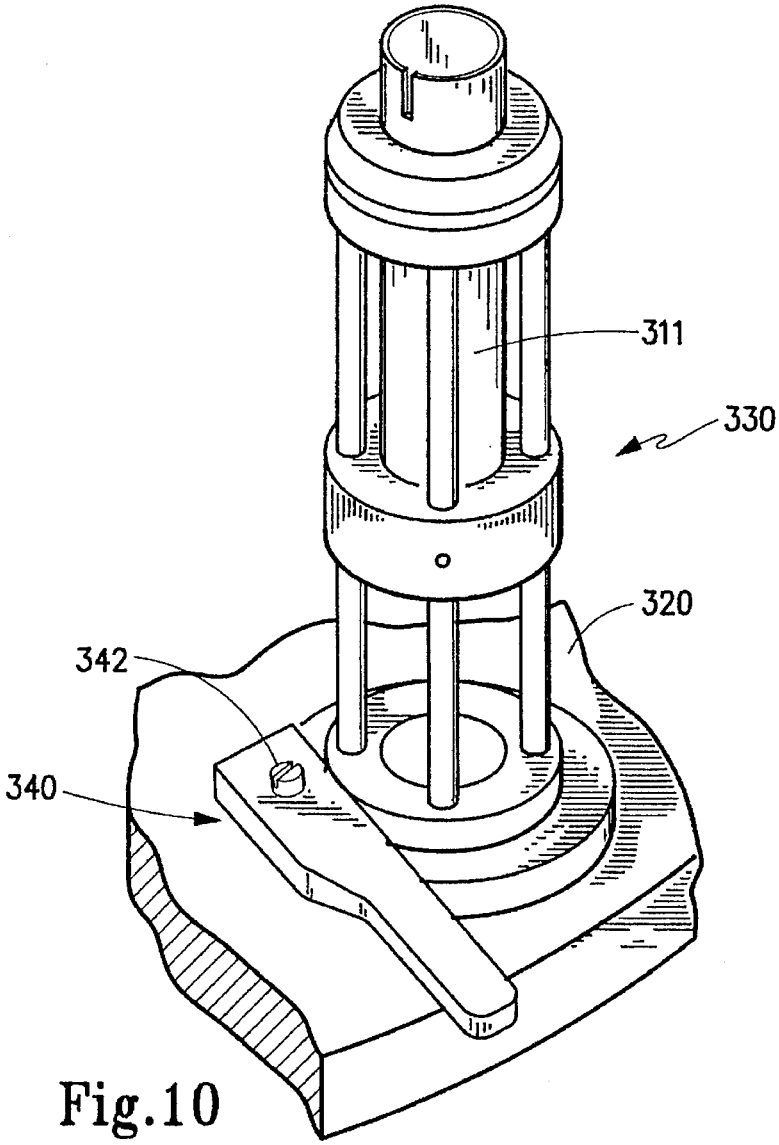
FIG. 10 is a perspective view of a rotor structure according to the present invention show with an alternative brake.
Figure 11:
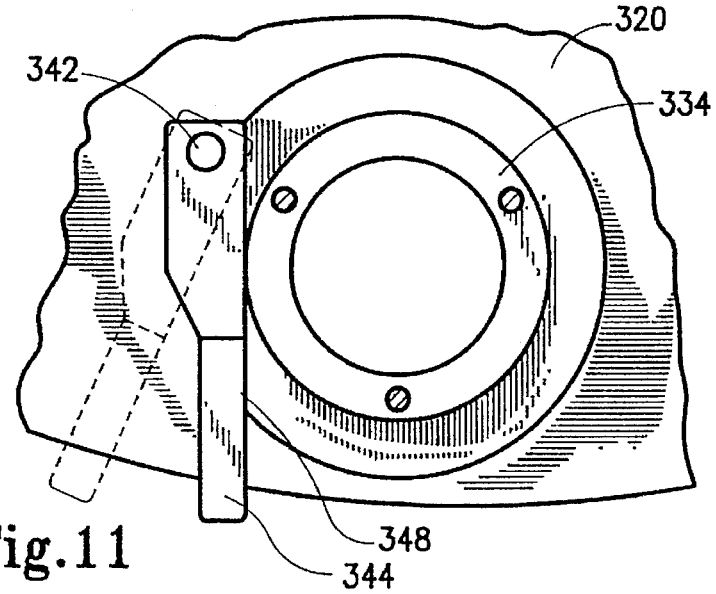
FIG. 11 is a top view in cross-section of the rotor structure and brake of FIG. 10.
Figure 12:
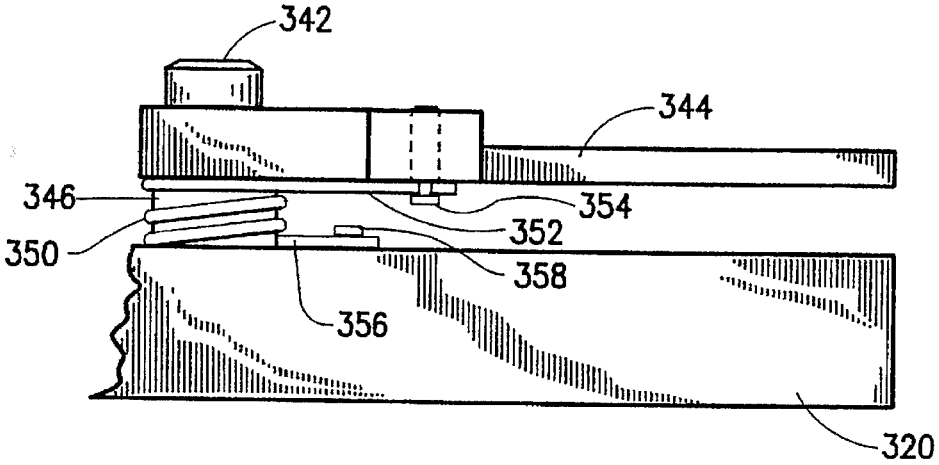
FIG. 12 is a side view of the brake shown in FIGS. 10 and 11.

An alternative exemplary embodiment of a braking assembly is shown in FIGS. 10-12. In these Figures, it may be seen that rotor assembly 330 supports a container 311. Rotor assembly 330 is of the same general type described with respect to FIGS. 2–9, above. Here, however, an alternative brake assembly 340 is provided and, as is shown in these Figures, is formed by a brake pivotally mounted on conveyor 320 by means of a pivot post 342. More particularly, the brake is provided by an arm member 344 which is pivotally retained conveyor 320 by pivot post 342 that is threadably received in a cylindrical mounting block 346 as is shown in FIG. 12. Thus, arm member 344 may pivot between a braking state shown in FIG. 11 and a release state shown in phantom in FIG. 11. In the braking state, arm member 344 has a side surface 348 that is tangentially in contact with rotor 334.

Arm member 344 is resiliently biased into the braking state shown in FIG. 11 by a tensioning spring. Tensioning spring 350 is best shown in FIG. 12 where it may be seen that spring 350 has a central portion spirally wound about cylindrical mounting 346. A first end portion 352 of spring 350 extends along the underside of arm member 344 to engage pin 354. A second end portion 356 extends along side conveyor 320 to terminate in at an end that engages pin 358. Spring 350 is tensioned so as to bias arm 344 into frictional engagement with rotor 334 thus to provide a braking action tending to prevent undesired rotation of rotor 334 and the associated supported container 311. However, when moved into the release state, again shown in phantom in FIG. 11, arm 344 is moved out of frictional contact with rotor 334 so as to allow free rotation thereof. Accordingly, arm member 344 provides a lever for applying this braking force. Again, any suitable actuator may be provided to move arm member 344 into and out of the braking and release state.

Accordingly, the present invention has been described with some degree of particularity directed to the preferred embodiments of the present invention. It should be appreciated, though, that the present invention is defined by the following claims construed in light of the prior art so that modifications or changes may be made to the preferred embodiments of the present invention without departing from the inventive concepts contained herein.

We claim:

1. A positioning apparatus operative to advance and rotationally orient a container during packaging of a product, comprising:

(a) a conveyor;

(b) a rotor assembly mounted on said conveyor for rotational movement about a rotor axis, said rotor assembly including a holder adapted to receive a container in a supported state as a supported container with the supported container being aligned along the rotor axis such that said supported container may be rotated about the rotor axis;

(c) rotary drive means mounted on said conveyor and operative to selectively engage said rotor assembly and the supported container for rotatably orienting said supported container with respect to the rotor axis; and (d) orientation sensing means for monitoring rotational orientation of the supported container, said conveyor operative to advance said rotor assembly and the supported container during the packaging of the product.

2. A positioning apparatus according to claim 1 wherein said conveyor is a rotary dial.

3. A positioning apparatus according to claim 1 wherein said holder includes a rotor, a plurality of rails mounted on said rotor and a first collar supported on said rails in spaced relation to said rotor and operative to receive the container, said rotor, said rails and said first collar mounted for common rotational movement about the rotor axis.

4. A positioning apparatus according to claim 3 wherein said first collar includes a gripping element operative to releasably grip the supported container.

5. A positioning apparatus according to claim 4 wherein said gripping element is a resilient O-ring.

6. A positioning apparatus according to claim 3 wherein said first collar is slideably disposed on said rails and including means for releasably locking said first collar in a selected position therealong.

7. A positioning apparatus according to claim 6 including a second collar disposed on said rails with said first collar positioned between said rotor and said second collar.

8. A positioning apparatus according to claim 7 wherein said first and second collars define a holder set, and including a plurality of interchangeable holder sets adapted to support containers of differing sizes.

9. A positioning apparatus according to claim 1 including a brake assembly associated with said rotor assembly, said brake assembly including a brake actuable between a braking state to prohibit rotational movement of said holder and a release state to allow rotational movement of said holder, and including a brake actuator operative to selectively place said brake in the braking state and the release state.

10. A positioning apparatus according to claim 9 wherein said rotor assembly includes a rotor disposed on said conveyor, said brake including an arm member movable into and out of frictional contact with said rotor.

11. A positioning apparatus according to claim 10 wherein said arm member is resiliently biased into the braking state.

12. A positioning apparatus according to claim 11 wherein said arm member is mounted to said conveyor proximate to said rotor for reciprocal movement tangentially thereto, said arm member including a shaft and an enlarged head whereby said enlarge head contacts said rotor when in the braking state and wherein said enlarged head is moved out of contact with said rotor when in the release state.

13. A positioning apparatus according to claim 11 wherein said arm member is a lever pivotally mounted to said conveyor proximate to said rotor for pivotal movement into contact with said rotor when in the braking state and out of contact with said rotor when in the release state.

14. A positioning apparatus according to claim 11 wherein said brake actuator is an air actuated cylinder operative upon actuation to move said arm member into the release state.

15. In a container filling apparatus adapted to fill a container with a product which includes a filling station operative to sequentially dispense product into containers, a rotary drive assembly operative to rotatably orient said containers, a sensing assembly operative to sense a selected rotational position for said containers, a sealing station operative to seal said containers and a conveyor operative to move said containers therebetween, an improvement comprising a plurality of rotors rotatably mounted to said conveyor at spaced-apart locations therealong on respective rotor axes to define container holding stations, each said container holding station including a holder adapted to receive a container in a supported state as a supported container with the supported container being aligned along the rotor axis such that said supported container may be rotated about the rotor axis, said rotary drive assembly operative to selectively engage said rotor assembly and the supported container for rotatably orienting said supported container with respect to the rotor axis, each said holder including a plurality of rails mounted on said rotor and a first collar supported on said rails in spaced relation to said rotor and operative to receive a respective container, each said rotor being mounted on said conveyor so that said rotor and its associated said rails and said first collar are mounted for common rotational movement about its respective rotor axis.

16. The improvement according to claim 15 including a brake assembly associated with each said rotor assembly, each said brake assembly including a brake actuable between a braking state to prohibit rotational movement of said holder and a release state to allow rotational movement of said holder, and including a brake actuator operative to selectively place said brake in the braking state and the release state.

17. The improvement according to claim 15 wherein each said first collar includes a gripping element operative to releasably grip the supported container.

18. The improvement according to claim 15 wherein each said first collar is slideably disposed on its associated said rails and including means for releasably locking said first collar in a selected position therealong.

19. The improvement according to claim 18 wherein each said holder includes a second collar disposed on its associated said rails with said first collar positioned between said rotor and said second collar.

20. The improvement according to claim 19 wherein said first and second collars define a holder set, and including a plurality of interchangeable holder sets adapted to support containers of differing sizes.

21. A positioning apparatus operative to advance and rotationally orient elongated tubular containers during packaging of a product wherein said containers have a closed end and an open end, comprising:

(a) a conveyor;

(b) a plurality of rotors each mounted on said conveyor for rotational movement about a respective rotor axis;

(c) a plurality of rails mounted on each said rotor as a rail set; and (d) an annular first collar supported on each said rail set in spaced relation to its respective said rotor and operative to receive the container with said container being aligned along a respective rotor axis, said rotor being mounted on said conveyor so that said rotor, said rail set and said first collar are mounted for common rotational movement about the rotor axis, each said collar being slideably adjustable along said rails of the rail set whereby containers of differing lengths may have their respective open ends positioned in a common imaginary plane located in spaced relation above said conveyor, and including means for releasably locking each said first collar in a selected position along said rails.

22. A positioning apparatus according to claim 21 including a brake assembly associated with said rotor, said brake assembly including a brake actuable between a braking state to prohibit rotational movement of said rotor and a release state to allow rotational movement of said rotor, and including a brake actuator operative to selectively place said brake in the braking state and the release state.

23. A positioning apparatus according to claim 21 wherein each said first collar includes a gripping element operative to releasably grip the supported container.

24. A positioning apparatus according to claim 23 wherein each said first collar has an inner sidewall and has an annular channel formed in said inner sidewall, said gripping element being a resilient O-ring received in said channel.

25. A positioning apparatus according to claim 21 including a second collar disposed on each rail set with said first collar positioned between said rotor and said second collar.

26. A positioning apparatus according to claim 25 wherein said first and second collars define a holder set, and including a plurality of interchangeable holder sets adapted to support containers of differing diameters.

27. A positioning apparatus according to claim 22 each said brake includes an arm member movable into and out of frictional contact with a respective said rotor.

28. A positioning apparatus according to claim 27 wherein each said arm member is resiliently biased into the braking state.

29. A positioning apparatus according to claim 28 wherein said rotors are organized as rotor pairs, there being an arm member mounted to said conveyor between each said rotor in each of the rotor pairs for reciprocal movement tangentially to both said rotors in the rotor pairs, said arm member including a shaft and an enlarged head whereby said enlarge head contacts both said rotors when in the braking state and wherein said enlarged head is moved out of contact with both said rotors when in the release state.

* * * * *